US007284283B2

(12) United States Patent
Mack et al.

(10) Patent No.: US 7,284,283 B2
(45) Date of Patent: Oct. 23, 2007

(54) INTEGRATED GLOVE AND METHOD FOR MANUFACTURING SAME

(75) Inventors: David J. Mack, Concord, NH (US); Peter A. Kirk, Manchester, NH (US); Robert T. Currier, Canterbury, NH (US)

(73) Assignee: Saint-Gobain Performance Plastics Corporation, Wayne, NJ (US)

( * ) Notice: Subject to any disclaimer, the term of this patent is extended or adjusted under 35 U.S.C. 154(b) by 271 days.

(21) Appl. No.: 10/967,639

(22) Filed: Oct. 18, 2004

(65) Prior Publication Data

US 2007/0220653 A1 Sep. 27, 2007

(51) Int. Cl.
*A41D 19/00* (2006.01)

(52) U.S. Cl. ..... 2/161.6; 2/16

(58) Field of Classification Search ..... 2/16, 2/20, 161.1, 161.6, 163
See application file for complete search history.

(56) References Cited

U.S. PATENT DOCUMENTS 4,469,744 A 9/1984 Grot et al.
4,792,480 A 12/1988 Freund et al.
4,816,330 A 3/1989 Freund et al.
4,865,903 A 9/1989 Adiletta
4,918,756 A 4/1990 Grilliot et al.
4,923,741 A 5/1990 Kosmo et al.
4,943,473 A * 7/1990 Sahatjian et al. ..... 442/289
5,123,119 A * 6/1992 Dube ..... 2/168
5,349,705 A 9/1994 Ragan
5,740,551 A * 4/1998 Walker ..... 2/16
5,832,539 A * 11/1998 Williams ..... 2/239
6,036,811 A * 3/2000 McGraw ..... 156/251

FOREIGN PATENT DOCUMENTS

EP 0 723 647 B1 5/1998

OTHER PUBLICATIONS

Technology Information Services Search Results, 54 pgs, Aug. 24, 2004.
NFPA 1991 Standard on Vapor-Protective Ensembles for Hazardous Materials Emergencies, 2000 Edition, National Fire Protection Association, 49 pages, 2000.
NFPA 1992 Standard on Vapor-Protective Ensembles for Hazardous Materials Emergencies, 2000 Edition, National Fire Protection Association, 42 pages, 2000.
NFPA 1994 Standard on Vapor-Protective Ensembles for Hazardous Materials Emergencies, 2001 Edition, National Fire Protection Association, 42 pages, 2001.

* cited by examiner

*Primary Examiner*—Katherine Moran
(74) *Attorney, Agent, or Firm*—Larson Newman Abel Polansky & White, LLP; Chi Suk Kim

(57) ABSTRACT

The disclosure is directed to an integrated glove including first and second substrate layers. The first substrate layer overlies the second substrate layer to define a volume therebetween configured to receive a wearer's hand. The integrated glove also includes first and second gas impermeable barrier layers respectively melt laminated to the first and second substrate layers. The first and second gas impermeable barrier layers extend beyond an outer contour of the first and second substrate layers and are melt laminated together to form a seam portion. The integrated glove has a breakthrough time greater than 60 minutes when exposed to NFPA 1991 industrial chemicals.

19 Claims, 4 Drawing Sheets

INTEGRATED GLOVE AND METHOD FOR MANUFACTURING SAME

FIELD OF THE DISCLOSURE

Figure 1:
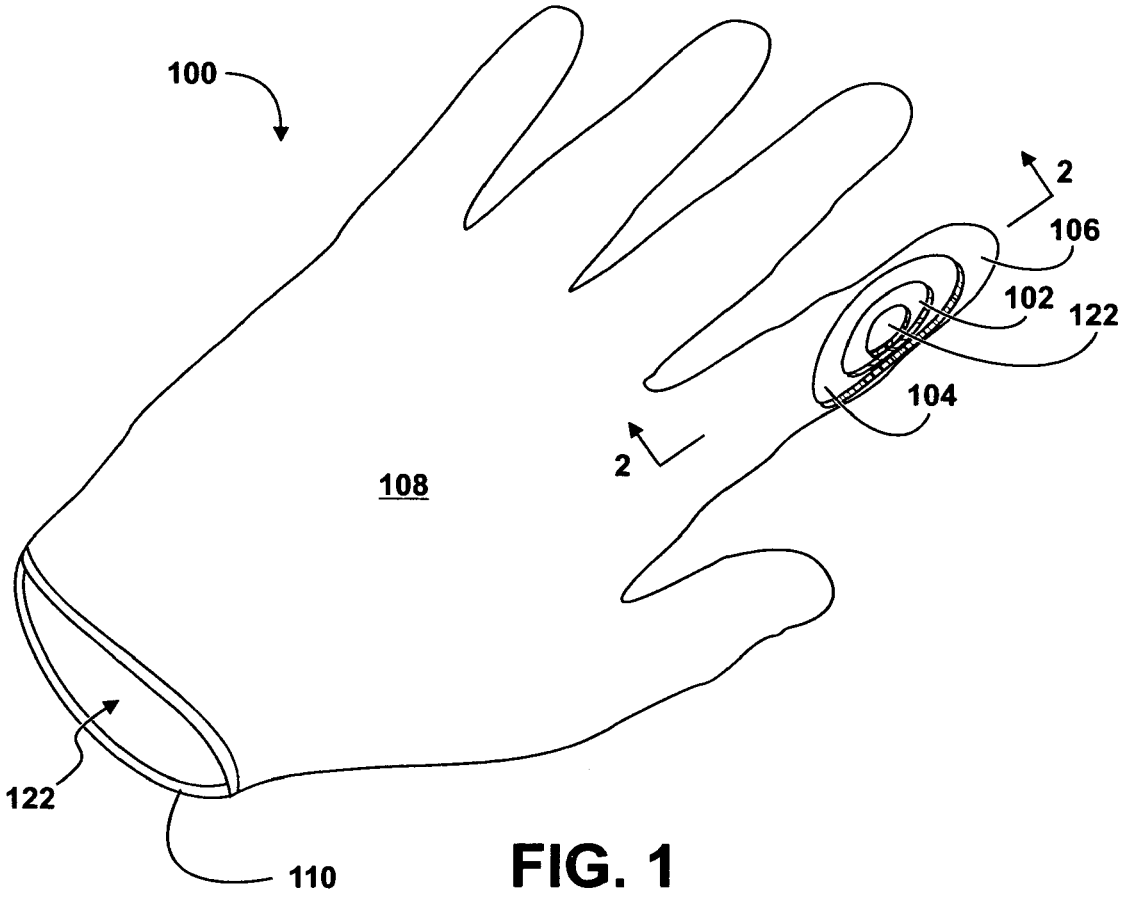

This disclosure, in general, relates to integrated gloves and methods for manufacturing same.

BACKGROUND

Industry has increasingly become aware of the impact of industrial chemicals on the health of personnel exposed to such chemicals. In addition, government agencies are under increasing pressure to plan for attacks, particularly including terrorist attacks that use chemical and biological agents. As a result, there is an increasing interest in protective clothing and garments. For example, early emergency responders, such as fire and EMS personnel, desire protective covering to protect them from industrial chemicals, biological agents, warfare chemicals and extreme temperatures. Other emergency responders and military users, such as hazardous material removal personnel, are also interested in protective clothing.

As a result of the increased interest, standards, such as NFPA 1991, NFPA 1992, and NFPA 1994, have been developed. However, many traditional protective clothing designs and, in particular, traditional gloves and glove systems fail to meet the standard requirements.

Traditional glove systems include a set of gloves that are optionally worn by a user. The user may, for example, select and don an inner glove, then select and don an intermediate glove, and then select and don an outer glove. Since the gloves are optional, the user may selectively change the capabilities of the glove system by failing to put on a particular glove layer. As such, no single glove passes the stringent protective clothing standards such as NFPA 1991, NFPA 1992 or any class of NFPA 1994. Similarly, if any one glove in the traditional glove system is omitted, the suit ensemble certification to the above-mentioned standards is voided. As such, an improved glove system would be desirable.

SUMMARY

In one particular embodiment, the disclosure is directed to an integrated glove including first and second substrate layers. The first substrate layer overlies the second substrate layer to define a volume therebetween configured to receive a wearer's hand. The integrated glove also includes first and second gas impermeable barrier layers respectively melt laminated to the first and second substrate layers. The first and second gas impermeable barrier layers extend beyond an outer contour of the first and second substrate layers and are melt laminated together to form a seam portion. The integrated glove has a breakthrough time greater than 60 minutes when exposed to NFPA 1991 industrial chemicals.

In another exemplary embodiment, the disclosure is directed to an integrated glove including a substrate and a barrier film melt laminated to the substrate and comprising gas impermeable film. The integrated glove has a breakthrough detection time greater than 60 minutes when exposed to NFPA 1991 industrial chemicals.

In a further exemplary embodiment, the disclosure is directed to a method of forming an integrated glove. The method includes overlaying a first substrate layer over a second substrate layer to define a space therebetween configured to receive a wearer's hand and melt laminating first and second gas impermeable films to the first and second substrate layers, respectively. The first and second gas impermeable barrier films extend beyond the contour of the first and second substrate layers to define a seam portion at which the first and second gas impermeable barrier layers are melt laminated together.

BRIEF DESCIPTION OF THE DRAWINGS

The present disclosure may be better understood, and its numerous features and advantages made apparent to those skilled in the art by referencing the accompanying drawings.

FIG. 1 includes a diagram illustrating an exemplary glove.

Figure 2:
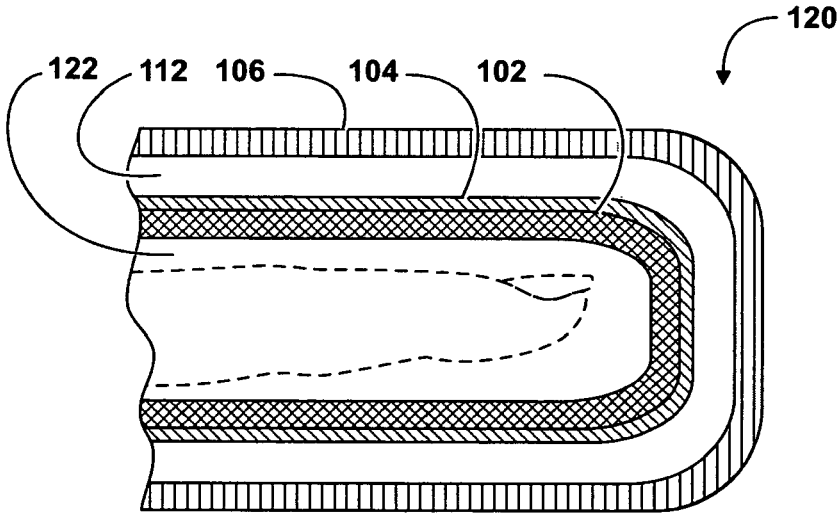

FIG. 2 includes a diagram illustrating an exemplary glove finger.

Figure 3:
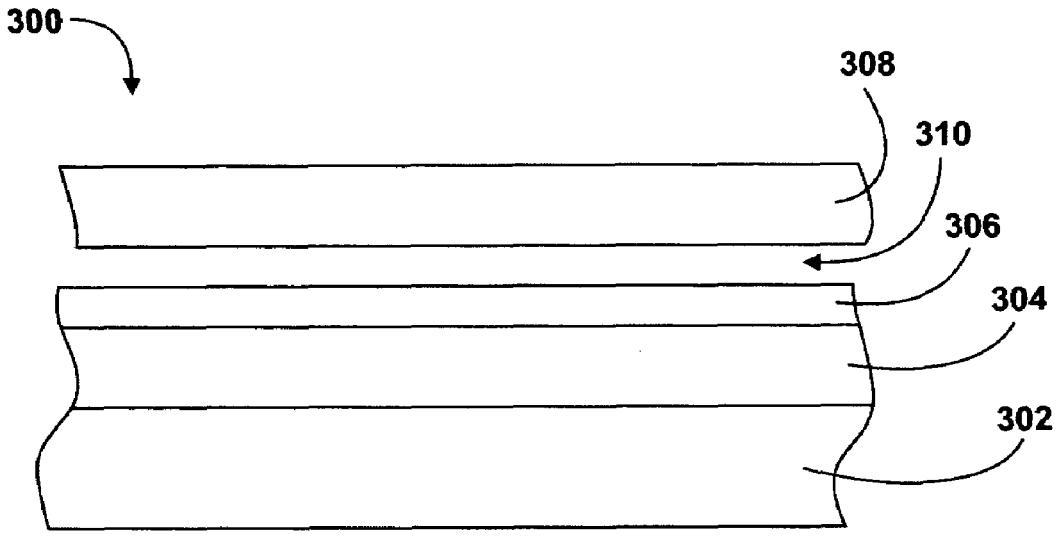

FIG. 3 includes a block diagram illustrating an exemplary layered construction for use in a glove.

Figure 4:
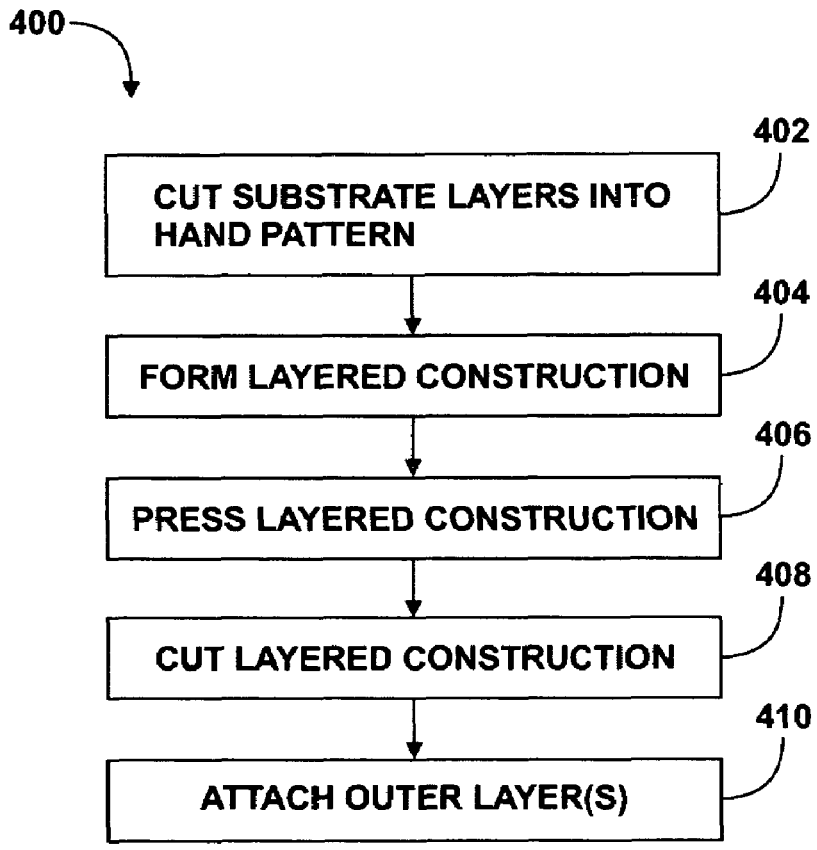

FIG. 4 includes a flow diagram illustrating an exemplary method for manufacturing a glove.

FIGS. 5, 6, 7 and 8 include diagrams illustrating exemplary embodiments of a glove.

The use of the same reference symbols in different drawings indicates similar or identical items.

DETAILED DESCRIPTION OF THE DRAWINGS

In one particular embodiment, the disclosure is directed to an integrated glove including a substrate and a barrier film. The barrier film is formed of a gas impermeable film and is melt laminated to the substrate. The integrated glove may include an outer layer. In one exemplary embodiment, the integrated glove has a breakthrough detection time greater than 60 minutes when exposed to NFPA 1991 industrial chemicals.

In another exemplary embodiment, the integrated glove includes first and second substrate layers that overlie each other to define a volume configured to receive a wearer's hand. The glove may further include first and second gas impermeable barrier layers respectively melt laminated to the first and second substrate layers, the first and second gas impermeable barrier layers extending beyond an outer contour of the first and second substrate layers and being melt laminated together to form a seam portion. The integrated glove has a breakthrough time greater than 60 minutes when exposed to NFPA 1991 industrial chemicals. In addition, the integrated glove may include an outer layer coupled to the first and second gas impermeable barrier layers. For example, the outer layer may be adhesively coupled or sewn to the seams of the gas impermeable barrier layers.

In another exemplary embodiment, the disclosure is directed to a method of forming an integrated glove. The method includes overlaying a first substrate layer over a second substrate layer to form or define a cavity therebetween configured to receive a wearer's hand. The method further includes melt laminating a first gas impermeable barrier film and a second gas impermeable film to the first and second substrate layers, respectively. Portions of the first and second gas impermeable films extend beyond the contours of the first and second substrate layers and are melt laminated together to form a seam portion. The method may further include coupling an outer glove construction to the first and second gas impermeable films, such as through adhesively coupling or through sewing the outer layer to the seam portion.

FIG. 1 illustrates an exemplary glove 100 that includes a hand portion 108 and a cuff region 110. In this exemplary embodiment, the glove 100 includes a substrate 102, a barrier layer 104 and an outer layer 106. FIG. 2 depicts an illustrative finger 120 of the glove 100. In one exemplary embodiment, the substrate 102 may be formed from two substrate layers configured to reside one on either side of a wearer's hand, such that they form a space 122 between the layers configured to receive the wearer's hand. These two substrate layers may be sewn or attached together to form a seam or seams around the contour of the substrate layers. In another example, the layers may be composed of a single sheet that is folded. In a further example, the substrate layers may be unattached to each other. Alternatively, the substrate 102 may be formed of layers forming a single three-dimensional construction having the space 122, such as a knitted material having no seams. As should be clear, it is not necessary that the layers are separate, discrete sheets of material. The layers may be formed of a continuous sheet, fabric, or weave of material, and that description herein of 'layers' associated with the substrate generally denotes layers of material as viewed in cross section in an un-donned state. The barrier layer 104 is laminated to the substrate 102, such as through melt laminating.

Optionally, a space 112 may be formed between the barrier layer 104 and outer layer 106. The outer layer 106 may be coupled to the barrier layer 104. For example, the outer layer may be sewn to the barrier layer 104 along a seam, at a tab or at a cuff, adhesively coupled at points to the barrier layer 104, or melt laminated at discrete points or along seams of the barrier layer 104.

Various cuff styles may be added to the glove system that allow for added protection and/or comfort. These include wrist-grips and suction flanges that attach the cuff region 110 to a protective suit. The cuff region 110 may be configured to extend along a wearer's arm at lengths based on the intended use and environment of the integrated glove. In one particular embodiment, the cuff region 110 is configured to extend at least 25 mm beyond the wrist crease of a wearer, such as an intended wearer or an average adult wearer. In another exemplary embodiment, the cuff region 110 is configured to extend half way or more along a wearer's forearm.

In this manner, an integrated glove is formed that includes a barrier layer 104 laminated to a substrate 102. The barrier layer includes a gas impermeable film. Exemplary embodiments of the integrated glove system conform to standards, such as NFPA 1991, NFPA 1992, and NFPA 1994.

In one exemplary embodiment, the integrated glove provides vapor protection from and chemical permeation resistance to industrial chemicals, such as acetone, acetonitrile, anhydrous ammonia (gas), 1,3-butadiene (gas), carbon disulfide, chlorine (gas), dichloromethane, diethyl amine, dimethyl formamide, ethyl acetate, ethylene oxide (gas), hexane, hydrogen chloride (gas), methanol, methyl chloride (gas), nitrobenzene, sodium hydroxide, sulfuric acid, tetrachloroethylene, tetrahydrofuran, and toluene. In a further exemplary embodiment, the glove exhibits chemical permeation resistance to cyanogen chloride (CK). Following a permeation resistance test in accordance with ASTM F 739 at 27° C.±2° C. for a test duration of at least 3 hours, the glove exhibits a breakthrough detection time of 1 hour or greater. For example, the glove may exhibit a breakthrough detection time of at least about 1.1 hours, such as at least about 1.5 hours or at least about 2 hours. The minimal detectable permeation rate is not more than 0.10 micrograms/cm$^2$/min. In another exemplary embodiment, the glove may be permeation resistant to chemical warfare agents such as lewisite (L), distilled mustard (HD), sarin (GB), and V-Agent (VX). For example, when tested with lewisite (L) and distilled mustard (HD), the integrated glove exhibits an average cumulative permeation in 1 hour that is less than about 4.0 micrograms/cm$^2$. In another exemplary embodiment, the integrated glove exhibits an average cumulative permeation over 1 hour that is less than 1.25 micrograms/cm$^2$ when exposed to chemical warfare agents, such as sarin (GB) and V-Agent (VX). In a further exemplary embodiment, the integrated glove exhibits chemical penetration resistance and exhibits no penetration for at least 1 hour for chemicals, such as acetone, acetonitrile, ethyl acetate, hexane, 50 weight percent sodium hydroxide solutions, 93.1 weight percent sulfuric acid solutions, and tetrahydrofuran. For example, penetration resistance may be measured in accordance with ASTM F 903 at 29° C.±3° C. and 65% plus or minus 5% relative humidity.

In a further exemplary embodiment, the integrated glove exhibits flammability resistance. For example, when tested in accordance with ASTM F 1359, the integrated glove does not ignite during an initial 3-second exposure period and does not burn a distance greater than 100 mm, does not sustain burning for more than 10 seconds, and does not melt as evidenced by flow or dripping during a subsequent 12-second exposure period.

In another exemplary embodiment, the integrated glove and the seams of the integrated glove are resistant to liquid or blood borne pathogens. For example, when tested in accordance with ASTM F 1671, the integrated glove demonstrates no penetration of the phi-x-174 bacterial phage for at least one hour. In another example, the seams are liquid tight. In another exemplary embodiment, the glove may be decontaminated with decontamination methods, such as autoclave.

In a further exemplary embodiment, the integrated glove exhibits cut and penetration resistance. For example, the integrated glove when measured in accordance with ASTM F 1790 exhibits a cut resistance performance not more than 25 mm, such as not more than about 21 mm or not more than about 19 mm. In a further exemplary embodiment, the integrated glove exhibits puncture resistance. For example, when tested in accordance with ASTM F 1342, the integrated glove exhibits a puncture resistance performance not less than 2.3 kg (5 lbs).

In a further exemplary embodiment, the integrated glove exhibits a cold temperature performance. For example, when tested in accordance with ASTM D 747, the integrated glove exhibits a bending moment of 0.057 N●meters at an angular deflection of 60° and −25° C.

The integrated glove may also exhibit dexterity as measured in accordance with the pegboard procedure listed in standard NFPA 1991. For example, the integrated glove may exhibit a dexterity performance, such as an average percent increase of bare hand control of less than 600%. For example, the dexterity performance may be not greater than about 400%, not greater than about 300%, not greater than about 200%, or not greater than about 120%.

FIG. 3 is a diagram that illustrates an exemplary layered structure 300 for use in formation of a glove. The layered structure 300 includes a gas impermeable film 304 that is laminated to a substrate 302. For example, the gas impermeable film 304 may be melt laminated to the substrate 302, such as through pressing the layers together under the influence of heat. The structure 300 may also include optional layer 306, such as a radiant barrier layer. In addition, the system may include an outer layer 308. Optionally, a void 310 is formed between the outer layer 308 and the gas impermeable film 304 or the optional layer 306.

Substrate layer 302 may take the form of fabric, foam or random fibrous material. The fabric may be a woven material or cloth. For example, the substrate layer may be a woven fabric. In another example, the substrate layer is a quilted random fiberous material. In a further example, the substrate layer includes polymeric foam. The substrate layer may be formed using synthetic fibers, such as aramids, such as meta- and para-aramids, such as Nomex® and Kevlar®, respectively, polyester, PBI, monoacrylic and modacrylic. The substrate layer 302 may alternatively be formed of natural fibers including cotton and wool. Further exemplary embodiments of the substrate material include Panox®, Lenzing, Technora®, Opan, Basofil, fiberglass, basalt, ceramic fibers, and carbon fibers. The substrate material may also include phase change materials that absorb energy when changing phase so as to cool a wearer of the glove. In another embodiment, the substrate material includes catalytic/oxidating materials that provide additional protection against chemical and biological agents. In one exemplary embodiment, the substrate layer 302 includes a woven aramid material, such as a Nomex® or Kevlar® material. In another exemplary embodiment, the substrate layer 302 includes a woven material formed of natural fibers, such as cotton or wool. In a further example, the woven material may be impregnated with absorbent material.

The substrate layer 302 forms an inner layer that is designed to contact the skin. As such, the substrate layer 302 may be selected to provide comfort to a wearer, such as through moisture wicking, moisture absorptivity and heat protection. In one exemplary embodiment, the material of the substrate layer 302 has at least about 3% moisture absorptivity by weight, such as about 4% to about 6% or at least about 6%.

The gas impermeable film 304 is laminated, such as melt laminated, to the substrate layer 302. The gas impermeable film 304 may be formed of polymers, such as fluoropolymers, perfluoropolymers, polytetrafluoroethylene (PTFE), THV, vinyl, rubber (including but not limited to Viton, butyl, and fluoroelastomers), PVC, uratane, acrylics, Tychem® and silicone. Generally, the gas impermeable film 304 is a thermoplastic film formed by a method that results in gas impermeability. For example, the gas impermeable film may include PTFE formed through a casting process. PTFE may also be formed in expanded films, skived films, extruded or co-extruded. However expanded films are generally gas permeable and skived films are generally more susceptible to faults and fractures that lead to gas permeability. Accordingly, cast PTFE is preferred.

In one particular embodiment, the gas impermeable film 304 includes a fluoroelastomer, a perfluorelastomers, a fluoroplastic, a perfluoroplastic, or a blend of fluoro- or perfluoroelastomers and fluoro- or perfluoroplastics. In one particular embodiment, the fluoropolymer is a fluoroplastic polytetrafluoroethylene (PTFE). Moreover, the film may comprise a blend of a fluoropolymer and a polyimide, a polyamideimide, or a polyphenylene sulfide.

The term "fluoroplastic" as used herein encompasses both hydrogen-containing fluoroplastics and hydrogen-free perfluoroplastics, unless otherwise indicated. Fluoroplastic includes polymers of general paraffinic structure which have some or all of the hydrogen replaced by fluorine, including, inter alia, polytetrafluoroethylene (PTFE), fluorinated ethylene propylene (FEP) copolymer, perfluoroalkoxy (PFA) resin, homopolymers of polychlorotrifluoroethylene (PCTFE) and its copolymers with TFE or $VF_2$, ethylene-chloro-trifluoroethylene (ECTFE) copolymer and its modifications, ethylenetetrafluoroethylene (ETFE) copolymer and its modifications, copolymers of TFE with pentafluoropropylene, polyvinylidene fluoride (PVDF), and polyvinylfluoride (PFV).

Similarly, the term "fluoroelastomer" as used herein shall encompass both hydrogen-containing fluoroelastomers as well as hydrogen-free perfluoroelastomers, unless otherwise indicated. Fluoroelastomer includes polymers with elastomeric behavior or a high degree of compliance containing one or more fluorinated monomers having ethylenic unsaturation, such as vinylidene fluoride, and one or more comonomers containing ethylenic unsaturation. The fluorinated monomer may be a perfluorinated mono-olefin, for example hexafluoropropylene, pentafluoropropylene, tetrafluoroethylene, and perfluoroalkyl vinyl ethers, e.g. perfluoro (methyl vinyl ether) or (propyl vinyl ether). The fluorinated monomer may be a partially fluorinated mono-olefin which may contain other substituents, e.g. chlorine or hydrogen. The mono-olefin is preferably a straight or branched chain compound having a terminal ethylenic double bond. The elastomer may include units derived from fluorine-containing monomers. Such other monomers include, for example, olefins having a terminal ethylenic double bond, especially ethylene and propylene. The elastomer will normally consist of carbon, hydrogen, oxygen and fluorine atoms. The fluoropolymer component may include a functional group such as carboxylic and sulfonic acid and salts thereof, halogen, as well as a reactive hydrogen on a side chain.

In exemplary embodiments, the elastomers are copolymers of vinylidene fluoride and at least one other fluorinated monomer, such as one or more of hexafluoropropylene, pentafluoropropylene, tetrafluoroethylene and chlorotrifluoroethylene. Commercially available fluoroelastomers include copolymers of vinylidene fluoride and hexafluoropropylene, such as Viton A, sold by DuPont; terpolymers of vinylidene fluoride, hexafluoropropylene and tetrafluoroethylene, such as Viton B sold by DuPont (and similar copolymers sold by 3M as FLUOREL, by Daiken as DAIEL, and by Montefluous as TECHNIFLON), and copolymers of vinylidene fluoride and chlorotrifluoroethylene, such as Kel-F sold by 3M. The use of AFLAS, which is a copolymer of TFE and propylene, as manufactured by Asahi, is also contemplated.

Exemplary perfluoroelastomers include elastomeric copolymers of tetrafluoroethylene with perfluoro (alkyl vinyl) comonomers, such as hexafluoropropylene or perfluoro (alkyl ether) comonomers that may include a perfluoroalkyl or perfluoro (cyclo-oxa alkyl) moiety. Other exemplary variations of perfluoroelastomer are found in US Patent 4,943,473, columns 3 and 4, incorporated herein by reference.

In one exemplary embodiment, fillers or additives such as pigments, plasticizers, stabilizers, softeners, extenders, and the like, can be present in the film composition. For example, there can be present substances such as graphite, carbon black, titanium dioxide, alumina, alumina trihydrate, glass fibers, beads or microballoons, carbon fibers, magnesia, silica, wall-astonite, mica, and the like.

The fluoropolymer-containing film, which may comprise one or more layers of varying content, is typically prepared separately. The independent formation of the film permits development of a uniform, low stress, finely metered layer prepared specifically for subsequent application to the substrate. In one exemplary embodiment, the film is prepared by casting in preparation for decalcomania transfer or fusion roll lamination. In such a technique, the film is formed upon a support member that may be any dimensionally stable membrane, such as a metal foil, particularly aluminum foil, or a compatible polymeric film, such as skived PTFE or KAPTON® polyimide film. Other techniques for film formation include melt extrusion or coextrusion and calendering. The lamination of a melt adhesive to the substrate with subsequent coating by the fluoropolymer film is contemplated.

The fluoropolymer-containing film components are generally less than about 5 mil thick, resulting in composites of sufficiently flexibility for use in garments. Such films may be about 0.25-4 mil thick to achieve good protection and flexibility, such as about 1-2 mil thick. The fluoropolymer-containing film, such as a PTFE containing film, may be formed of multiple layers, such as at least about 6 layers. For example, a PTFE containing film may be formed of at least about 7 layers, at least about 10 layers, at least about 12 layers, or about 20 layers or more.

Returning to FIG. 3, an optional layer 306 may be included. The optional layer 306 may be laminated to the gas impermeable film 304 via adhesive coupling or melt lamination. Alternatively, the optional layer 306 may be sewn to seams or tabs formed by the gas impermeable film 304. The optional layer 306 may be formed of plastics. metal, or ceramics. In one exemplary embodiment, the optional layer 306 may function as a radiant barrier and includes reflective metal films, such as silver shield. In another exemplary embodiment, the optional layer 306 includes ceramic material configured to provide additional heat protection. In a further exemplary embodiment, the optional layer 306 includes a foam material, such as silicone foam, to provide additional heat resistance and puncture resistance.

In one particular embodiment, the optional layer 306 provides additional reinforcement to the barrier film 304. For example, a glass fiber reinforced PTFE layer may be added to regions around the fingers, around the cleft between fingers, and over a back portion of the glove. The glass fiber reinforced PTFE layer may have a different shrinkage rate, leading to curvature during processing. In particular, the optional layer 306 may provide tear resistance.

The outer layer 308 may be coupled to the optional layer 306 or the gas impermeable film 304. In one exemplary embodiment, the outer layer 308 is adhesively coupled at distinct locations to the gas impermeable film 304 or optionally layer 306. In another exemplary embodiment, the outer layer 308 is spot melt laminated to the intermediate layers at distinct locations or sewn to tabs or seams about the periphery of the intermediate layers, 304 and optionally 306. The outer layer 308 may be formed of either a woven or non-woven material and may be formed from materials including synthetic fibers, such as aramids, such as Nomex® and Kevlar®, polyester, PBI and modacrylic. The outer layer 308 may alternatively be formed of natural fibers including cotton and wool. Further exemplary embodiments of the outer layer material include Panox®, Lenzing, Technora®, Opan, Basofil, fiberglass, basalt, ceramic fibers, carbon fibers, and catalytic/oxidating and phase change materials.

In one particular embodiment, the integrated glove includes an inner liner or substrate layers of woven Nomex® fibers, forming a volume configured to receive a wearer's hand. Although the term substrate layers, in the plurality, is used herein in connection with some embodiments, it is to be understood that the layers can be in the form of a continuous layer, such as where the first and second layers are The substrate layers are melt laminated to a cast PTFE gas impermeable barrier layers. The gas impermeable barrier layers extend beyond the contours of the substrate layers and are melt laminated together to form a seam. This melt laminated construction forms an isolated internal region within the integrated glove. In addition, the seam may be configured to provide tabs, such as at fingertips, or may be configured to provide a seam region. An outer layer formed of woven Kevlar® may be sewn to the tabs or the seam region without penetrating the gas impermeable barrier formed by the barrier layers and without violating the isolated internal region.

The integrated glove may, for example, be formed through the exemplary method illustrated in FIG. 4. The method 400 includes cutting substrate layers into patterns, as shown at step 402. For example, the substrate layers may be cut into hand patterns that exhibit a contour resembling a hand.

A layered construction may be formed, as shown at step 404. For example, a first substrate layer may overly a second substrate layer and form a cavity or volume configured to receive a hand therebetween. First and second gas impermeable films are respectively placed on the outside surfaces of the first and second substrate layers. In one exemplary embodiment, the first and second gas impermeable films include portions that extend beyond the contours of the substrate layers. For example, larger square gas impermeable films may be placed on either side of the first and second substrate layers having a contour of the hand.

Figure 5:
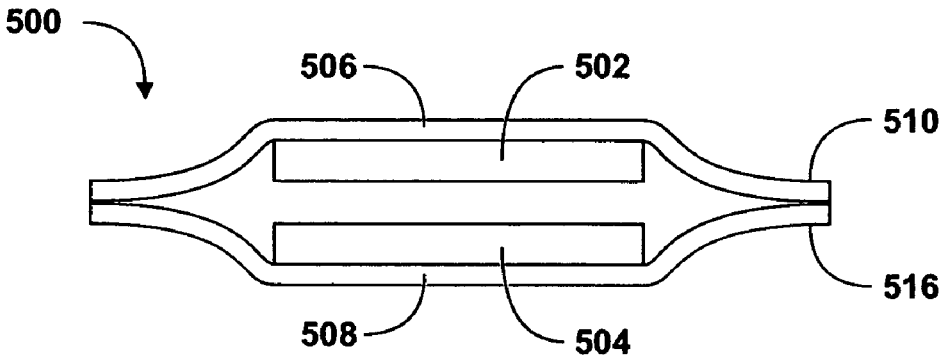

The layered construction is pressed and heated to melt laminate the gas impermeable films to the substrate layers and to each other, as shown at step 406. For example, the gas impermeable films are melt laminated to each other in the regions that extend beyond the contours of the first and second substrate layers. FIG. 5 illustrate an exemplary embodiment 500 in which the first substrate layer 502 and second substrate layer 504 are surrounded by respective first barrier film 506 and second barrier film 508. In regions 510 and 516, the barrier films 506 and 508 are melt laminated to each other to form a seam or scal on either side of the contours of the substrate layers 502 and 504.

Figure 6:
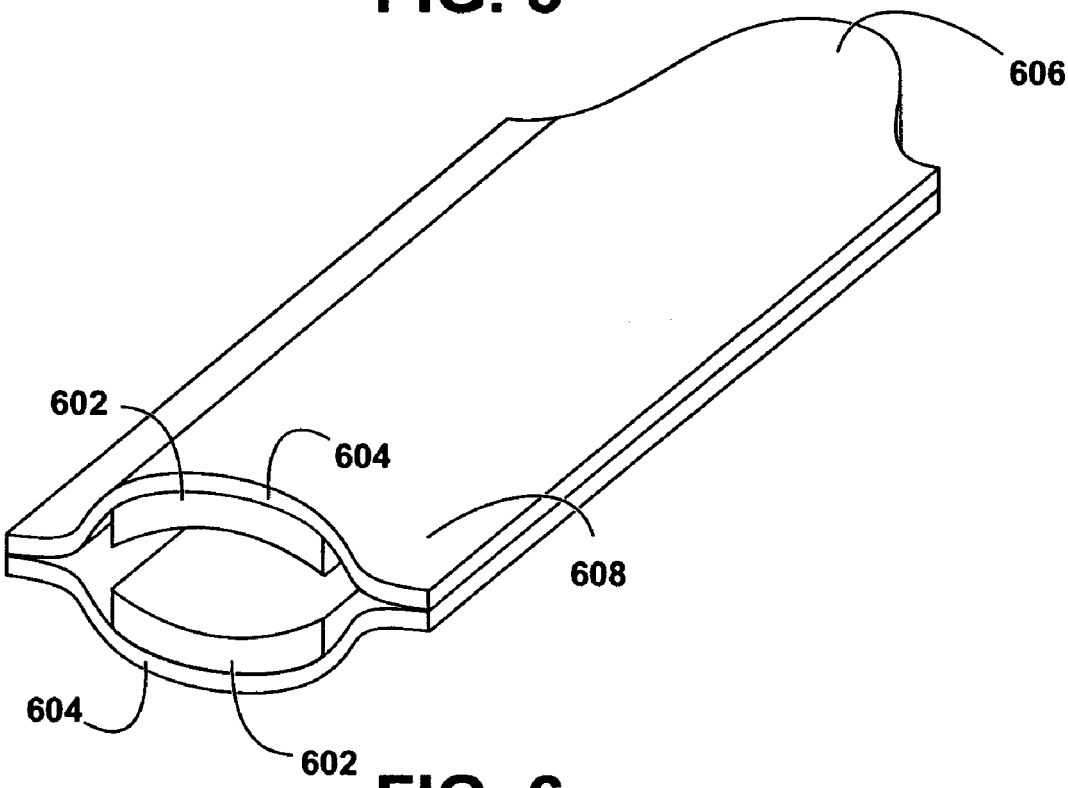

Returning to FIG. 4, the layered construction may be cut into the shape of a hand, as shown at step 408. The portions of the barrier films that extend beyond the contours of the substrate layers form a seam and may form additional tabs, such as at a fingertip or along the seam. For example, FIG. 6 depicts an exemplary finger of a glove that includes substrate layers 602 and barrier films 604. Along the contour of the finger, the seam portion 608 is formed and at the tip of the finger, a tab 606 is formed.

Returning to FIG. 4, an outer layer may be attached, as shown at step 410. For example, the outer layer may be sewn to the seam or tabs. In an alternate embodiment, the outer layer may be melt laminated or heat tacked at discrete points about the glove, sewn to the outer layer and substrate layers at a cuff, or adhesively coupled at points to the barrier film.

Figure 7:
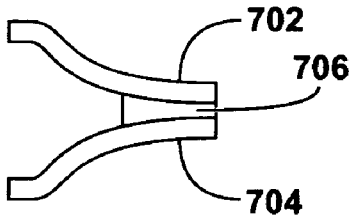

FIG. 7 illustrates an alternative embodiment in which a reinforcement layer is inserted between the barrier layers at points about the seam or at high stress points. For example, a reinforcement layer 706 may be inserted between gas impermeable films 702 and 704 prior to melt lamination. In one exemplary embodiment, the reinforcement layer 706 includes melt fluoropolymers or additional bonding films.

Figure 8:
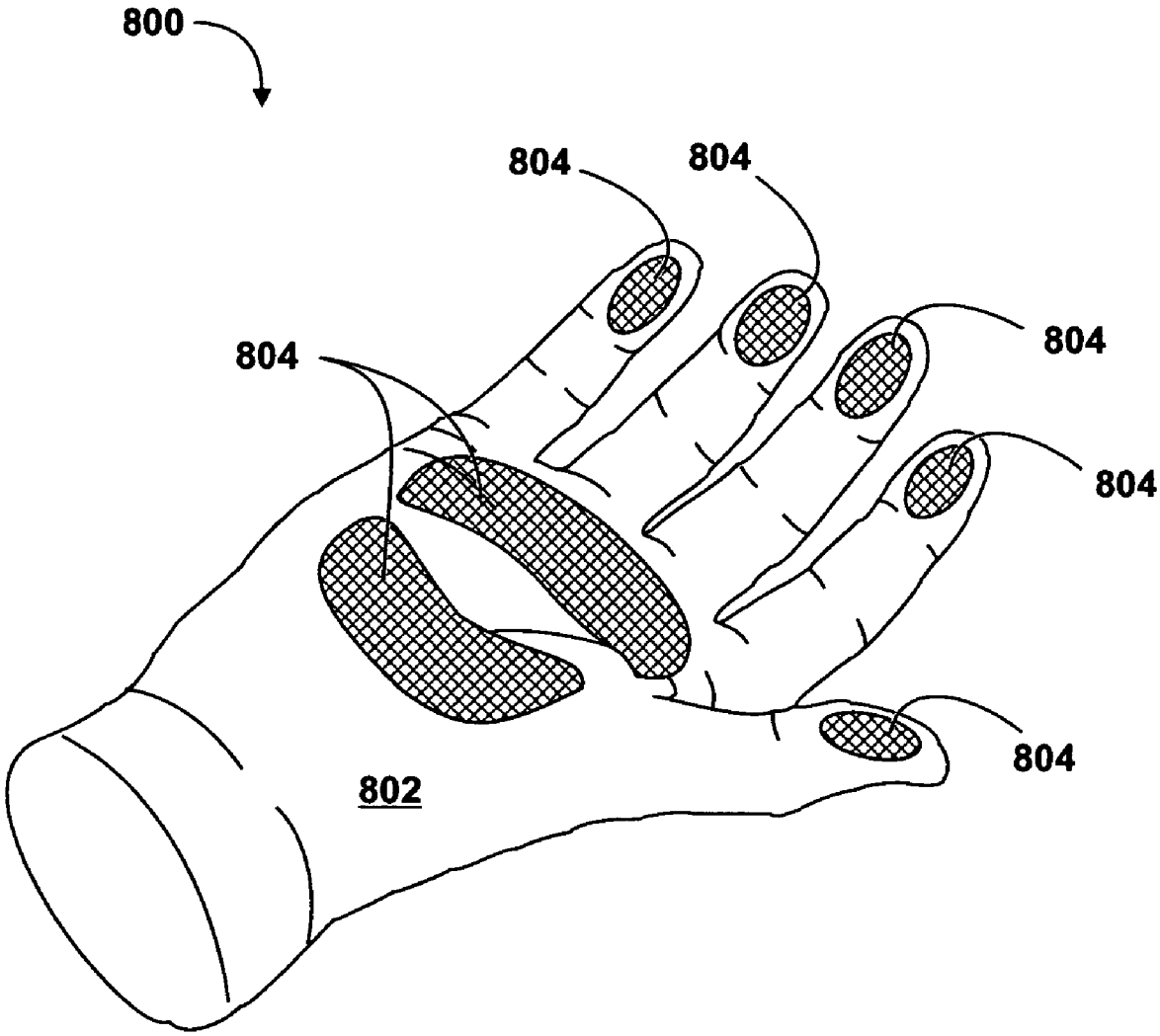

Additional features may be incorporated into the glove. For example, the outer layer may include embroidered patterns. Such embroidered patterns may add to the strength of the glove in certain high stress regions. In addition, the glove may include rubber grippers attached to the outer shell to aide in friction resistance. For example, FIG. 8 depicts an exemplary pattern of rubber grippers 804 attached to the outer shell 802 of a glove 800. In further exemplary embodiments, foam pads may be included in various locations to aide in cut and puncture resistance and hot and cold temperature resistance.

The glove may be configured in a full five-finger configurations, other multi-fingered configurations, or mitten configurations. In a further exemplary embodiment, the outer glove may include reflective materials that may be patterned on the glove. In addition, repellants and coatings may be applied to the outer glove that reduce absorption of materials such as water, oil, condensates and solvents.

Example:

Substrate material formed of 3.5-4.0 oz/yrd$^2$ stitch-bonded Nomex® was cut into two hand-shape contour layers. The two substrate layers were placed between two films of 3 mil cast PTFE containing multilayer film to form an intermediate construction. The PTFE multilayer film was formed in accordance with U.S. Pat. No. 4,943,473, which is incorporated herein by reference.

The intermediate construction was pressed using 30,000 tonnes and a temperature of 323° C. (615° F.) for 25 seconds. The pressed construction was cut and an outer layer of woven Kevlar® was sewn at a cuff to the to the pressed and cut construction.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. An integrated glove comprising:

first and second substrate layers, the first substrate layer overlying the second substrate layer to define a volume therebetween configured to receive a wearer's hand;

first and second gas impermeable barrier layers respectively melt laminated to the first and second substrate layers, the first and second gas impermeable barrier layers extending beyond an outer contour of the first and second substrate layers and being melt laminated together to form a seam portion; and wherein the integrated glove has a breakthrough time greater than 60 minutes when exposed to NFPA 1991 industrial chemicals.

2. The integrated glove of claim 1, further comprising an outer layer coupled to the first and second gas impermeable barrier layers.

3. The integrated glove of claim 2, wherein the outer layer is adhesively coupled to the first and second gas impermeable barrier layers.

4. The integrated glove of claim 2, wherein the outer layer is sewn to the first and second gas impermeable barrier layers.

5. The integrated glove of claim 4, wherein the integrated glove includes a cuff configured to surround a wrist region of a wearer, the outer layer is sewn to the first and second gas impermeable barrier layers along the cuff.

6. The integrated glove of claim 2, wherein the outer layer comprises para-aramid.

7. The integrated glove of claim 1, wherein the first and second gas impermeable barrier layers comprise cast PTFE.

8. The integrated glove of claim 1, wherein the integrated glove includes fingers including finger tips, the glove extending from the finger tips to at least 25 mm beyond a wrist crease of a wearer.

9. The integrated glove of claim 1, wherein the integrated glove has a cumulative permeation performance over a 60 minute period of less than 4.0 micrograms/cm$^2$ for Lewisite (L) and Distilled Mustard (HD), in accordance with ASTM F 739.

10. The integrated glove of claim 1, wherein the integrated glove has a cumulative permeation performance over a 60 minute period of less than 1.25 micrograms/cm $^2$ for Sarin (GB) and VX, in accordance with ASTM F 739.

11. The integrated glove of claim 1, wherein the integrated glove exhibits flammability resistance, in accordance with ASTM 1358.

12. The integrated glove of claim 1, wherein the integrated glove exhibits cut resistance performance less than 25 mm, in accordance with ASTM F 1790.

13. The integrated glove of claim 1, wherein the integrated glove exhibits puncture performance of at least 2.3 kg, in accordance with ASTM F 1342.

14. A method of forming an integrated glove, the method comprising:

overlaying a first substrate layer over a second substrate layer to define a space therebetween configured to receive a wearer's hand; and layers, respectively, the first and second gas impermeable films extending beyond an outer contour of the first and second substrates layers to define a seam portion at which the first and second gas impermeable films are melt laminated together.

15. The method of claim 14, further comprising attaching an outer glove construction to the first and second gas impermeable films.

16. The method of claim 15, wherein the seam portion defines a tab and wherein attaching the outer glove construction includes sewing the outer glove construction to the tab.

17. The method of claim 15, wherein attaching the outer glove construction includes heat tacking the outer layer to the first and second gas impermeable films.

18. The method of claim 15, wherein attaching the outer glove construction includes adhesively coupling the outer glove construction to the first and second gas impermeable films.

19. The method of claim 14, further comprising cutting the first and second gas impermeable films after melt laminating.

* * * * *

UNITED STATES PATENT AND TRADEMARK OFFICE

CERTIFICATE OF CORRECTION

PATENT NO. : 7,284,283 B2
APPLICATION NO. : 10/967639
DATED : October 23, 2007
INVENTOR(S) : David J. Mack et al.

It is certified that error appears in the above-identified patent and that said Letters Patent is hereby corrected as shown below:

Column 10, claim 14, line 5, delete "layers," and insert therefore --melt laminating first and second gas impermeable films to the first and second substrate layers,--.

Signed and Sealed this

Twelfth Day of August, 2008

JON W. DUDAS
*Director of the United States Patent and Trademark Office*